US007217880B2

(12) United States Patent
Sant

(10) Patent No.: US 7,217,880 B2
(45) Date of Patent: May 15, 2007

(54) PREVIOUS EVENT FEEDBACK SYSTEM FOR ELECTRONIC PLAYER PIANO SYSTEMS

(75) Inventor: Mark Van Sant, Oregon House, CA (US)

(73) Assignee: Burgett, Inc., Sacramento, CA (US)

( * ) Notice: Subject to any disclaimer, the term of this patent is extended or adjusted under 35 U.S.C. 154(b) by 0 days.

(21) Appl. No.: 11/385,148

(22) Filed: Mar. 20, 2006

(65) Prior Publication Data

US 2006/0156905 A1 Jul. 20, 2006

Related U.S. Application Data

(63) Continuation of application No. PCT/US2005/002073, filed on Jan. 20, 2005.

(51) Int. Cl.
*G10H 7/00* (2006.01)
*G10F 1/02* (2006.01)

(52) U.S. Cl. ..... 84/645; 84/21

(58) Field of Classification Search ..... 84/13, 84/21, 626, 645, 735
See application file for complete search history.

(56) References Cited

U.S. PATENT DOCUMENTS 5,164,532 A 11/1992 Isii et al.
5,200,562 A 4/1993 Kaneko et al.
5,231,283 A 7/1993 Starkey et al.
5,237,123 A 8/1993 Miller
5,237,125 A 8/1993 Fields
5,451,708 A 9/1995 Fujiwara et al.
5,530,198 A * 6/1996 Ishii ..... 84/21
5,648,621 A 7/1997 Sasaki
6,051,762 A 4/2000 Fujiwara et al.
6,271,447 B1 * 8/2001 Fujiwara et al. ..... 84/21
6,359,207 B1 3/2002 Oba et al.
6,403,872 B2 6/2002 Murumatsu et al.
6,472,589 B1 10/2002 Lee
6,969,791 B2 * 11/2005 Fujiwara ..... 84/13
2005/0132871 A1 6/2005 Oba et al.

* cited by examiner

*Primary Examiner*—Jeffrey W Donels
(74) *Attorney, Agent, or Firm*—John P. O'Banion

(57) ABSTRACT

A method of utilizing previous event feedback information from historical derived hammer velocity data, such as associated with a MIDI record function, for providing non-real-time feedback when controlling actuators. The use of non-real-time feedback within the present invention provides a number of advantages over the use of conventional real-time feedback mechanisms. Utilization of the non-real-time (historical) key actuation information reduces the amount of circuitry necessary for correcting the operation of the actuators (i.e. solenoids) during playback on the instrument. By way of example, a programmable circuit element receives velocity information on previous key strikes for adjusting the actuator velocity output signal which will be generated for future key strikes. The accuracy of key strike normalization provided by this method approaches that which is achievable using real-time feedback, because the velocity profiles for each key remain substantially constant during playback.

20 Claims, 3 Drawing Sheets

PREVIOUS EVENT FEEDBACK SYSTEM FOR ELECTRONIC PLAYER PIANO SYSTEMS

CROSS-REFERENCE TO RELATED APPLICATIONS

This application claims priority from, and is a 35 U.S.C. § 111(a) continuation of, co-pending PCT international application serial number PCT/US2005/002073, filed on Jan. 20, 2005, which designates the U.S., incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND OF THE INVENTION

1. Field of the Invention

This invention pertains generally to circuitry for electronically controlled acoustic musical instruments, and more particularly to note actuator feedback circuits within player pianos.

2. Description of Related Art

Player pianos continue to get more sophisticated in the pursuit of optimizing performance reproduction. However, the increased sophistication often leads to increased cost factors which reduce market penetration in certain market segments and limit both market advantage and profits.

One of these cost factors arises from the use of real-time feedback circuitry which assures that each actuator provides a similar response to a given stimulus, thus normalizing actuator outputs "on-the-fly". In order to provide accurate playback, player piano systems employ real-time feedback for sensing the motion of the key mechanism, (i.e. plunger, piano key or hammer) and applying correction to actuator signals while the actuator is active during a key strike. One such form of feedback comprises a Hall Effect sensor coupled for sensing the velocity of the mechanism in response to actuator activity. The measured velocity is compared with the expected velocity and a correction factor applied during the keystroke to correct for error. The real-time feedback thus assures that the actual output properly tracks the expected output. The feedback is typically applied continuously over the key strike in the case of analog circuitry or periodically during the keystroke in the case of digital circuitry.

It will be recognized that sensing hardware, such as Hall Effect sensors, must be coupled to each of the eighty-eight (88) key mechanisms of the piano. Electronic circuitry is required for registering the data from these sensors and generating output corrections in real-time for all of the eighty-eight (88) keys. At least one feedback circuit function, such as a comparator, is required per piano key and more typically multiple comparators, op-amps, and/or other circuitry are necessary to generate proper real-time feedback. Attempts have been made at reducing or integrating analog elements in the feedback path, while multiprocessing has also been proposed which allows each of multiple processors to generate real-time feedback for a subset of the keys.

FIG. 1 represents the major functional elements and their interactions in a solenoid drive circuit 10 having real-time feedback and a performance recording system 12. A piano key 14 is shown operably coupled to a hammer mechanism 16 which translates the mechanical input on key 14 to a hammer motion for striking string 18. In a player piano system a solenoid 20 is coupled to hammer mechanism 16 for striking string 18 during playback of a note sequence. Solenoid 20 is shown comprising coil 22 and plunger 24. Plunger 24 is driven in response to the level of current passing through coil 22 to create a mechanical input to mechanism 16. It should be recognized that the coil current mentioned is preferably the average current level when the solenoid drive is controlled by a preferred pulse-width modulation (PWM) mechanism in which the duty cycle is modulated. It should also be recognized that other actuator types may be similarly utilized in place of solenoids.

A note stream is shown received by a controller 26, such as a microprocessor or other programmable element, which is configured to generate an output for each of the typically 88 keys for controlling the velocity of the hammers as they strike the strings, such as string 18. Typically the note information stream comprises musical instrument note control information formatted according to the musical instrument data interchange (MIDI) standard. It should be readily recognized that each combination of solenoid 20 and hammer mechanism 16 responds slightly differently to a given driving signal. Real time feedback was introduced into the playback portions of the circuit to correct the outputs so that hammer velocity is adjusted to match expected velocity as generated from the controller.

Real-time feedback corrects the solenoid driving force during a key strike to normalize the output which is in progress. The use of real-time feedback is implemented in a number of different ways within the industry. In this example controller 26 is shown outputting a first signal, with the connection of eighty-seven additional outputs not shown, to a first solenoid driver 28 which sinks drive current through coil 22 of solenoid 20 to drive plunger 24. Driver 28 is depicted as an operational amplifier connected in an inverting amplifier mode with circuits providing real-time feedback to control amplifier gain. A sensor 30 is mechanically coupled for sensing the velocity of mechanism 16 to provide input to a real time feedback stage 32 whose transfer function in the feedback path changes in response to sensed velocity in mechanism 16 during a key strike at the desired note velocity. Feedback stage 32 may comprise circuitry such as operational amplifiers, filters, and threshold comparators. It should be noted that since the feedback to driver circuit 28 is provided during playback of the key (key strike)

it compensates in real time to normalize strike velocity. It should also be recognized that digital equivalents to the analog block diagram shown in the figure have been described by player piano manufacturers for providing real-time actuator feedback.

Player pianos are often adapted for recording user performances for later playback as depicted in the figure by assembly 12. In registering performances a sensor 34 is coupled to each key 14 (or alternatively through mechanism 16) for registering key movement. The analog movement signal from sensor 34 is converted with an analog-to-digital converter 36 to a digital velocity signal and processed within a controller 38 along with signals from the typically eighty seven other keys to generate a note stream which can be stored in data store 40 (i.e. hard disk, memory device, etc.) for later selection and playback.

Implementing real-time feedback requires incorporating a number of circuits for each key and is thus costly in terms of both the circuitry needed as well as for the necessary printed circuit board real estate for interconnecting those circuits.

Accordingly, a mechanism for providing accurate control of actuator activation is needed which can be implemented at low cost with minimal circuitry associated with each key of the piano. The present invention fulfills that need and others while overcoming drawbacks with existing techniques.

BRIEF SUMMARY OF THE INVENTION

An apparatus and method for replacing the real-time feedback mechanism executed during playback with a non-real-time feedback mechanism executed in response to previous event feedback. It has not been fully appreciated in the industry that reducing the cost and number of feedback circuits for each key leads to significant cost saving because the savings in circuit elements is accumulated for each of the keys (i.e. 88) on the piano. Real-time feedback is necessary if one desires to correct fluctuations in key operation during a given key strike. However, in arriving at the present invention it has been recognized that nearly identical corrections are applied to a given key from one key strike to the next for a given expected output velocity. Therein, feedback to the key can be provided on a non-real-time basis during playback without significantly impacting playback accuracy.

By way of example, and not limitation, the non-real time actuation feedback of the invention is provided based on previous event data received from a set of key strike recording sensors. The sensor data preferably provides information to a programmable processing element (i.e. microprocessor, microcontroller, digital signal processor), or other responsive control circuit, in accord with the actual response from a given solenoid in relation to its stimulus. According to the present invention, the difference between the stimulus and response is retained as one or more non-real-time previous event feedback correction factors for each key so that increased correspondence between expected and actual velocity for the key can be achieved.

In one embodiment of the invention the sensors utilized for recording key activity during a user performance are also utilized during playback for registering actual key velocity. Utilizing a single set of detectors instead of two sets of detectors can significantly reduce the cost of implementation. However, it should be appreciated that the present invention can receive actual key strike feedback from any movement sensitive means without departing from the teachings of the present invention.

Utilizing previous event feedback for correcting subsequent actuator output eliminates the need for additional circuitry associated with each key for performing real-time correction. The processing element according to the invention performs an additional step to apply the non-real-time correction, registers the actual output, and then updates the non-real-time correction factor, or factors for the given key. Unlike conventional systems that provide real-time feedback during the key strike, the use of previous event feedback is based on registering key trajectory information during a key strike and uses that data for correcting future activations of that key. In one embodiment of the invention, the previous event feedback is received from circuitry configured for providing a MIDI-based record function, wherein sensors track key activations, or more preferably movement within the hammer mechanism which is also subject to solenoid activation. Typically, the MIDI-based recording is registered by a sensor coupled to each key and preferably a means of converting the sensor data to a digital output for processing by a microprocessor. In this way the recording circuits perform double duty as they operate during both recording and playback. Utilization of the non-real-time (historical) key actuation information reduces the amount of circuitry necessary for correcting the operation of the actuators (i.e. solenoids) during playback on the instrument.

In one embodiment, an apparatus for regulating note velocity within an acoustic instrument providing programmed playback comprises: (a) means for retaining a repository of previous event feedback data; (b) means for applying previous event feedback data from said repository to a note velocity value received from a note information stream to generate a note actuation signal for driving a note within an acoustic instrument; (c) means for registering the actual note velocity of a note which has been driven; and (d) means for updating the previous event feedback data in said repository in response to the registration of the actual note velocity in relation to the note actuation signal that was driving the note. The technique is particularly well suited for use in a player piano instrument in which the notes are activated by note actuators (i.e. solenoids, etc.) coupled to a hammer mechanism for striking the strings of the piano. The input note information stream preferably comprises a MIDI note stream received for playback by the instrument. The instrument is preferably configured for providing either playback of a digital note stream or recording of a user performance as a digital note stream (i.e. MIDI output). In one embodiment of the invention both the means for applying previous event feedback and the means for updating previous event feedback are performed by a controller circuit, which preferably comprises a programmable processing element. A means for registering the actual note velocity can be provided by a movement sensor coupled to the note generation mechanism. The sensor can comprise any sensor or combination of sensors which are capable of detecting resultant note velocity, such as motion sensor, pressure sensor, hall-effect sensor, piezoelectric sensor, electric-field sensor, inductive sensor, capacitive sensor, and so forth. In the case of a player piano instrument a movement sensor is preferably coupled to the hammer mechanism for each key.

An embodiment of the invention can be described as an acoustic player piano, comprising: (a) a housing; (b) a plurality of note strings within the housing; (c) a plurality of keys, each associated with one of the note strings; (d) a hammer mechanism coupling motion from each of the keys for striking a hammer against each of the strings; (e) a plurality of sensors configured for detecting the movement of the hammer mechanism for each of the plurality of keys; (f) a plurality of actuators configured for driving the hammer mechanism in response to the receipt of actuator control signals; (g) a microprocessor circuit configured for receiving a source of note information, said microprocessor coupled (i.e. directly or indirectly) to the plurality of actuators to control actuator activity and associated hammer velocity; (h) a data memory (i.e. RAM, NVRAM, FLASH, fixed or removable media, and so forth as well as any combinations thereof) coupled to the microprocessor configured for retaining programming as well as previous event feedback data; (j) programming executable on the microprocessor for, (j)(i) interpreting note information from the digital note stream, (j)(ii) reading (i.e. table look up, computations, etc.) previous event feedback data associated with each note whose information has been received and combined (i.e. multiplication, scaling, computation according to a fixed or variable equation, and the like as well as combinations thereof) that data with the note velocity information to produce an actuator control signal for each given key, (j)(iii) registering movement of the hammer mechanism for each given key being currently played in response to outputs from the plurality of sensors, (j)(iv) updating the previous event feedback data in response to the registered movement.

A driver circuit is preferably coupled between the microprocessor and the plurality of actuators to provide a proper type of drive signal and sufficient signal power for controlling actuator output. The driver converts, or enhances (i.e. voltage and/or current amplification, or duty cycle), microprocessor signal output from the microprocessor to drive activation of each of the plurality of actuators. It should be realized that the microprocessor or actuators can be adapted to allow the microprocessor to drive the actuators directly, without the need of a driver circuit. Examples of direct actuator driving include: using a microprocessor with a high-power analog output or pulse-width modulating output, using actuators having a digital input, using actuators having integral drive electronics, and so forth.

In addition, the programming of the microprocessor can further include encoding of signals received in response to the movement of the hammer mechanisms in response to manual key input, thereby providing a digital note stream record of a user performance. It should be appreciated that a performance recording option can be provided according to the present invention without the need of additional circuitry.

An embodiment of the invention may also be described as a method of regulating key strike velocity within an acoustic player piano, comprising: (a) receiving a note velocity value from within a note information stream; (b) outputting an actuator control signal for each note to be played back in response to combining the note velocity value with a previous event feedback data; (c) registering key trajectory information of each piano strike during playback; and (d) updating previous event feedback data in response to the registration of key trajectory information.

It should also be noted that the above method embodiment can also be restated as: (a) registering key trajectory information of each piano key during playback; (b) updating previous event feedback data in response to the registration of key trajectory information; and (c) outputting note velocity values for each note being played in response to combining a note velocity value from the note information stream and the previous event feedback data. In this description the previous event feedback data is considered to be updated prior to outputting the subsequent note, instead of after outputting a prior note.

Embodiments of the present invention can provide a number of beneficial aspects which can be implemented either separately or in any desired combination without departing from the present teachings.

An aspect of the invention is to provide normalizing of key strike velocity for a desired note velocity described by information within a note stream, such as a MIDI-based note stream.

Another aspect of the invention is to reduce the amount of circuitry needed for normalizing actuator outputs within a player piano system.

Another aspect of the invention is to utilize piano performance recording circuitry to provide actuator drive feedback within a player piano system.

Another aspect of the invention is to utilize information from previous key strikes to normalize the output of those specific keys being struck in the future.

Another aspect of the invention provides for simplification of the circuitry which is duplicated for each key of a player piano instrument.

A still further aspect of the invention is to provide a method of note actuation control which can be implemented at lower cost on any instrument configured for electromechanical playback.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Figure 2:
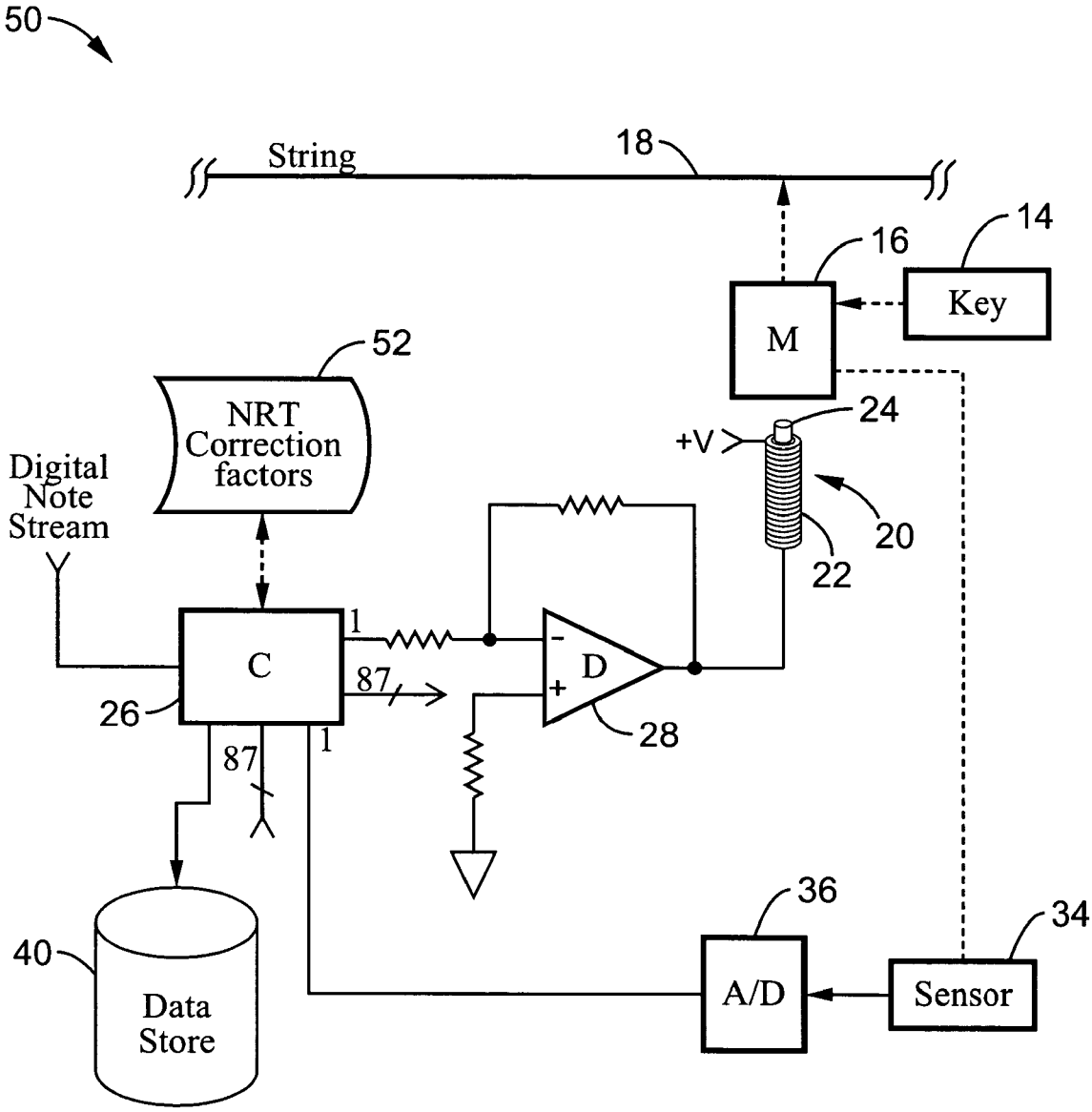
FIG. 2 is a schematic of a player piano mechanism according to an embodiment of the present invention, showing the use of non-real-time feedback based on previous event feedback.
Figure 3:
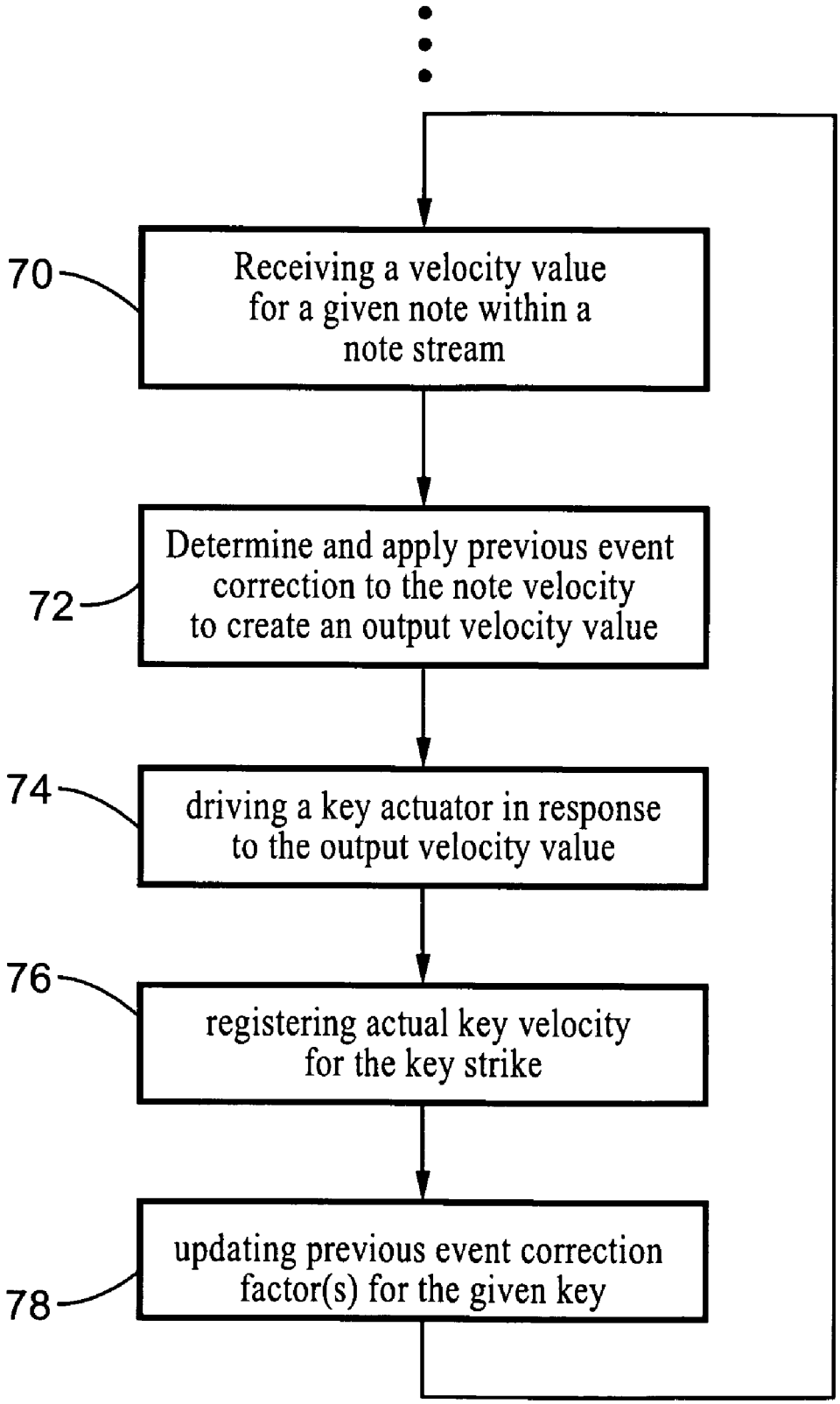
FIG. 3 is a flowchart depicting the use of non-real-time feedback within a player piano mechanism according to an embodiment of the present invention, showing the application of non-real-time corrections and the updating of previous event feedback data.

Referring more specifically to the drawings, for illustrative purposes the present invention is embodied in the apparatus and method generally shown in FIG. 2 through FIG. 3. It will be appreciated that the apparatus may vary as to configuration and as to details of the parts, and that the method may vary as to the specific steps and sequence, without departing from the basic concepts as disclosed herein.

Figure 1:
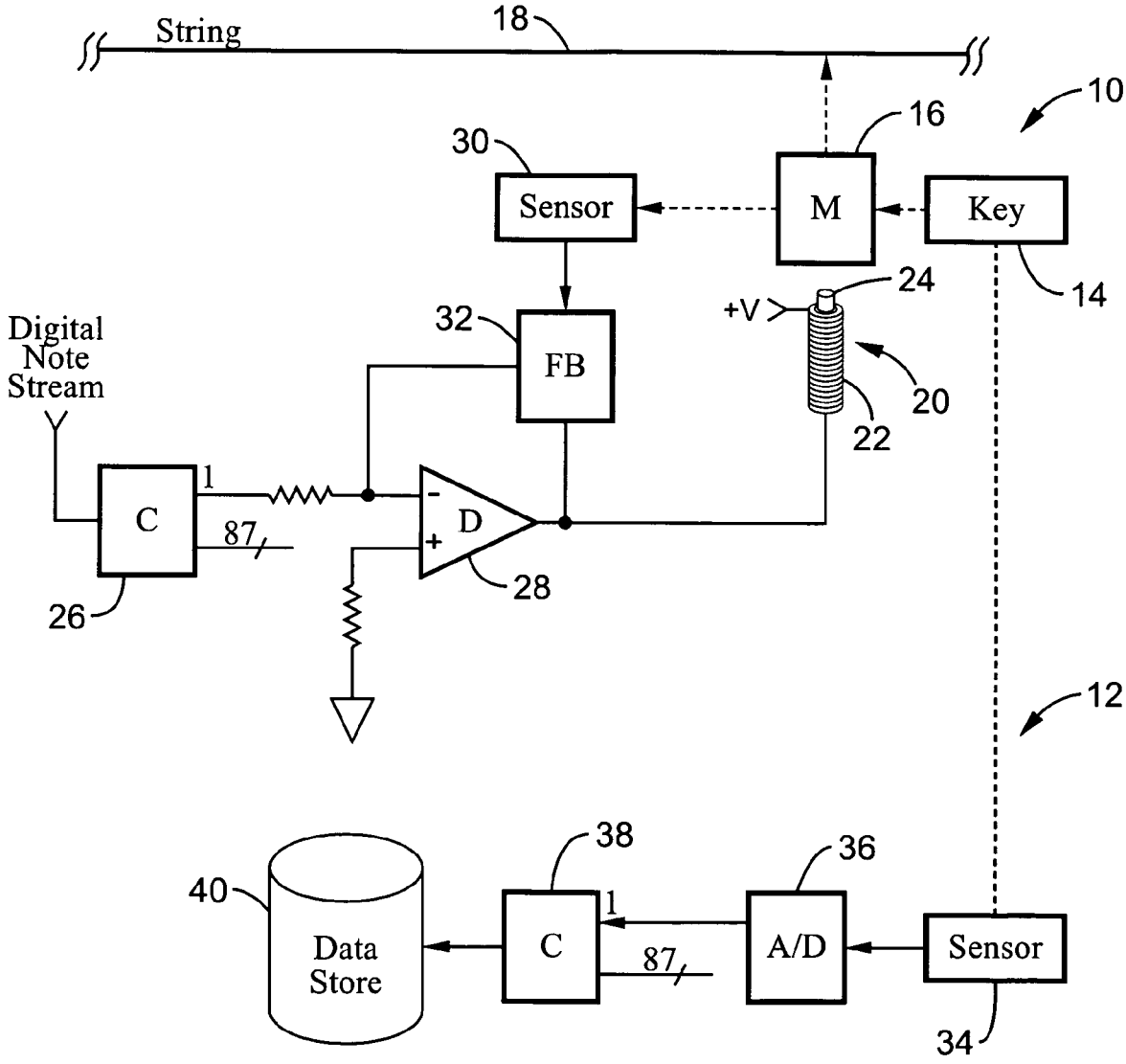
FIG. 1 (Prior Art)
FIG. 1 is a schematic of conventional player piano circuitry showing real-time feedback provided within a driver stage as well as the use of performance recording circuits.

FIG. 2 illustrates by way of example a player piano system 50 having a playback solenoid controlled through the use of non-real-time feedback. Comparing FIG. 2 with FIG. 1 a number of differences are readily apparent. The complex feedback circuit 32, as well as sensor 30, of FIG. 1 has been eliminated, with solenoid 20 now being driven in what can be referred to as an "open loop" mode, since the response is not being corrected while it is occurring based on its actual response. It can also be seen that a means for registering actual note velocity is provided by sensor 34. It should be recognized that sensor 34 may have been previously utilized for recording performances. The signal output from sensor 34 is preferably still converted to a digital signal 36 that is processed by playback controller 26, instead of a separate controller, prior to possible storage within data source 40. Controller 26 is utilized in combination with a means for retaining a repository of event feedback data. Controller 26 incorporates means for applying previous event feedback data to generate a note actuation signal, and a means for updating previous event feedback data in response to the registration of actual note velocity. The data from what was the "recording path" is utilized within the invention by controller 26 for maintaining a set of non-real-time (NRT) previous event correction factors 52. Prior to generating an output to driver 28, controller 26 adjusts the velocity value based on previous event feedback data collected about the response characteristics for any given key. In this way the strike velocity is corrected digitally based on historical information, instead of real-time feedback.

It will be appreciated that the player piano system of FIG. 2 is far simpler to implement while it can provide accuracy approaching that of conventional player piano circuits utilizing real-time feedback mechanisms. This historical, previous event, form of feedback can be accurately utilized because the transfer function for each combination of solenoid and mechanism typically remains relatively constant over at least the short term, and in particular during a given playback session.

During playback, the previous event feedback information is utilized for modifying the expected velocity value to apply a correction that is based on historical correspondence between the desired velocity levels represented by the actuator signals being output, and the actual historical key strike response velocity (trajectory). It should be appreciated that unless the mechanical response curves for a key suddenly change, the data stored from the current playback session, or even from prior playback sessions, should be reasonably accurate for correcting actuator operation. In one embodiment of the present system, the non-real-time previous event actuation data is collected on an ongoing basis for each keystroke, therein assuring that key velocity corrections are applied based on the most recent key strikes.

Previous event feedback data may be subject to replacement when new key data is made available, or more preferably the new data is averaged, or otherwise applied across a number of instances, to the feedback data. By performing updates according to an averaging mechanism the variations with regard to mechanical fluctuations and inaccuracies in the response measurement system can be moderated, resulting in less fluctuation of the correction factors between notes. In one example a rolling average mechanism can be utilized for updating the previous event feedback data. Although ongoing updates of the previous event data provide accuracy benefits, it should be appreciated that this is not required to practice the non-real-time approach described herein. Less preferably, the non-real time previous event feedback data can be collected in response to a specific playback session in which corrections factors are generated, such as during an initiation sequence after power up.

According to one embodiment, a single correction factor such as a ratiometric correction (i.e. positive or negative percentage correction), can be stored and applied to subsequent key strokes. In this embodiment the correction factor is multiplied against the expected velocity value to produce an output velocity value. Considering the case of a +4% velocity correction the computation is as follows: $(1+0.04)\times V_{EXPECTED}=V_{OUTPUT}$. Integer math can be utilized to speed computation in comparison with the use of floating-point computations, while processor overhead can be further reduced by utilizing multiplication tables, or performing basic arithmetic on values stored in a logarithm table. Alternatively, a combination of correction factors may be utilized, such as a percentage correction in combination with a predetermined correction offset. For instance an offset could be incorporated as: $(V_{OFFSET}+((1+0.04)\times V_{EXPECTED}))=V_{OUTPUT}$.

However, if key response across a range of expected velocities is subject to significant non-linearities, then maintaining a single correction factor for the key can be subject to continual change (i.e. "hunting") as the value is continually being significantly altered in response to key activity registered across a range of key velocities. For example, consider a highly non-linear response in which a low key velocity correction factor of +6% is needed while at a high key velocity a correction factor of −1% is required. In this extreme case of non-linearity the use of a single correction factor by itself would not provide effective correction.

Therefore, in systems subject to significant non-linearities it may be desirable to store the non-real-time correction factors to span the expected velocity range. For example correction factors may be computed and applied for different portions of the velocity range, such as at low, mid-range, and high velocities. For instance the previous event feedback can be stored as a percentage correction within each of different ranges of expected hammer velocity. Previous event feedback can also be looked up in a table of correction factors based on an interpolation mechanism capable of determining intermediate values between those registered in the table. Alternatively, larger data tables can be utilized to reduce or eliminate the need for interpolation. Another alternative is the use of equation forms of correction whose coefficients or even forms are modified to suit the response of the key mechanism. It should, however, be recognized that updating equations is typically subject to higher processing overhead than updating table values. In consideration of these many approaches, it should be appreciated that the previous event feedback correction factor can be generated, stored, and retrieved in a number of alternative forms without departing from the teachings of the present invention.

In one embodiment of the invention it is preferred that the previous event feedback data be retained in a form of non-volatile memory storage (i.e. battery-backed RAM, FLASH memory, fixed media, removable media and so forth) so that accurate playback is assured upon restoring power to the instrument. Alternatively, or additionally, it is preferred that if actual previous event feedback data is not available for all velocity settings for a key, that the available data for the key be extrapolated in a best fit approach for the additional velocity settings. In this way reasonably accurate performance reproduction is assured, while correction factors determined during playback continue to increase playback accuracy.

FIG. 3 illustrates an example of using previous event feedback within a player piano system. A flowchart is shown of processing steps, such as performed by firmware or software being executed from a memory store by a controller. It should be noted that the present system can be embodied as a combination of hardware and software (or firmware), or alternatively implemented completely in software (i.e. distributed on a chip, on a media, or by download) for controlling a player piano having suitable hardware.

It should be appreciated that the flowchart blocks depicted in the figure represent steps associated with the use of non-real-time feedback during playback, whereas in a working player piano system numerous additional steps may be necessary to play back each note. A note stream is received by the playback system which is typically parsed to provide data for each key (note) that is to be played. Block 70 represents the receipt of the note velocity value for a given note from within the note stream. Previous event feedback is determined and applied as per block 72 to the desired velocity value to produce a "pre-corrected" output velocity value which drives a key actuator as given by block 74 toward producing an "nth" key strike. The correction factors are then preferably updated by registering in block 76 the actual key velocity attained for the "nth" key strike. Block 78 represents the step of updating, as necessary, the previous event correction factors so as to maintain consonance between the desired note velocity as recited in the note stream, and the actual note velocity as applied between the hammer and string. In one embodiment of the invention previous event feedback is stored, such as in a ratiometric form, for each of different levels of key velocity, wherein correction of key velocity can be accurately performed based on velocity or velocity ranges.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for." Dependent recitations within the appended claims can be generally applied to any independent claim recitations to which a similar claim does not originally depend.

What is claimed is:

1. An apparatus for regulating note velocity within an acoustic instrument providing programmed playback, comprising:

means for retaining a repository of previous event feedback data;

means for applying previous event feedback data from said repository to a note velocity value received from a note information stream to generate a note actuation signal for driving a note actuator within an acoustic instrument;

means for registering the actual note velocity to which a note on said acoustic instrument has been driven; and means for updating said previous event feedback data in said repository in response to the registration of actual note velocity in relation to said note actuation signal that was driving said note.

2. An apparatus as recited in claim 1, wherein said acoustic instrument comprises a player piano.

3. An apparatus as recited in claim 2, further comprising:

a digital media player and recorder operably coupled to said acoustic instrument, wherein said digital player and recorder is configured for either playback of a digital note stream or recording of a user performance.

4. An apparatus as recited in claim 1, wherein said note information stream received during programmed playback is configured according to the musical information data interchange (MIDI) standard.

5. An apparatus as recited in claim 1:

wherein a combination of said means for applying and said means for updating comprises a controller circuit configured for applying previous event feedback data from said repository to a note velocity value received from a note information stream to generate a note actuation signal; and wherein said controller is further configured for updating said previous event feedback repository in response to the registration of actual note velocity for notes which have already been played.

6. An apparatus as recited in claim 5, wherein said controller circuit is selected from the group of circuits consisting essentially of programmable processing elements, microcontrollers, microprocessors, and digital signal processors.

7. An apparatus as recited in claim 1, wherein said means for registering actual note velocity comprises at least one movement sensor.

8. An apparatus as recited in claim 7, further comprising:

an analog-to-digital conversion circuit coupled to said at least one movement sensor;

wherein digital data from said digital conversion circuit is received by said controller circuit for said updating of said previous event feedback repository.

9. An apparatus as recited in claim 1, wherein said previous event feedback data comprises ratiometric adjustment data configured for being multiplied with a received note velocity value when generating said note actuation signal.

10. An acoustic player piano, comprising:

a housing;

a plurality of note strings within said housing;

a plurality of keys, each associated with one of said note strings;

a hammer mechanism coupling motion from each of said keys for striking a hammer against each of said strings;

a plurality of sensors configured for detecting the movement of said hammer mechanism for each of said plurality of keys;

a plurality of actuators configured for driving said hammer mechanism in response to the receipt of actuator control signals;

a microprocessor circuit configured for receiving a source of note information, said microprocessor coupled to said plurality of actuators to control actuator activity and associated hammer velocity;

a data memory coupled to said microprocessor which is configured for retaining programming as well as previous event feedback data; and programming executable on said microprocessor for, interpreting note information from the digital note stream, reading previous event feedback data associated with each note whose velocity information has been received and combining that with the note velocity information to produce an actuator control signal for each given key, registering movement of said hammer mechanism, in response to outputs from said plurality of sensors, for each given key being currently played, updating the previous event feedback data in response to said registered movement.

11. An apparatus as recited in claim 10, wherein said microprocessor is selected from the group of processing elements consisting essentially of: computers, microprocessors, microcontrollers, digital signal processors, or programmable processing elements.

12. An apparatus as recited in claim 10, further comprising analog-to-digital signal conversion circuitry coupled to said plurality of sensors for converting the output of said sensors to a digital signal for receipt by said microprocessor.

13. An apparatus as recited in claim 10, further comprising a driver circuit coupled between said microprocessor and said plurality of actuators, said driver circuit configured for converting a signal output from said microprocessor to drive activation of each of said plurality of actuators.

14. An apparatus as recited in claim 10, further comprising programming executable on said microprocessor for encoding signals, representing movement of the hammer mechanism in response to manual key input, to form a digital note stream record of a user performance.

15. A method of regulating key strike velocity within an acoustic player piano, comprising:

receiving a note velocity value from within a note information stream;

outputting an actuator control signal for each note to be played back in response to combining said note velocity value with a previous event feedback data;

registering key trajectory information of each piano strike during playback; and updating previous event feedback data in response to said registration of key trajectory information.

16. A method as recited in claim 15, wherein said note information stream is configured according to the musical information data interchange (MIDI) standard.

17. A method as recited in claim 15, wherein said registration of key trajectory information is performed in response to the electrical output of a sensor receiving mechanical input from key striking mechanisms within said acoustic player piano.

18. A method as recited in claim 15, further comprising encoding said key trajectory information within a note information stream to record a user performance.

19. A method as recited in claim 15, wherein a programmable circuit element is configured for said outputting of actuator control signals in response to previous event feedback and said updating of previous event feedback data.

20. A method as recited in claim 15, further comprising converting registered key trajectory information from each piano key into a digital data stream for use in updating previous event feedback data.

* * * * *